US009765460B2

(12) United States Patent
Schwarzberger et al.

(10) Patent No.: US 9,765,460 B2
(45) Date of Patent: Sep. 19, 2017

(54) METHOD, APPARATUS AND COMPUTER-READABLE MEDIUM FOR IMAGING

(71) Applicant: ABM International, Inc., The Woodlands, TX (US)

(72) Inventors: Neal A. Schwarzberger, The Woodlands, TX (US); William E. Schnaufer, Rochester, NY (US)

(73) Assignee: ABM International, Inc., The Woodlands, TX (US)

( * ) Notice: Subject to any disclaimer, the term of this patent is extended or adjusted under 35 U.S.C. 154(b) by 0 days.

(21) Appl. No.: 14/702,274

(22) Filed: May 1, 2015

(65) Prior Publication Data

US 2016/0319473 A1 Nov. 3, 2016

(51) Int. Cl.

| | |
|---|---|
| ***G06F 7/66*** | (2006.01) |
| ***D05B 19/08*** | (2006.01) |
| ***D05B 11/00*** | (2006.01) |
| ***D05B 19/12*** | (2006.01) |

(52) U.S. Cl.

CPC ..... *D05B 19/08* (2013.01); *D05B 11/00* (2013.01); *D05B 19/12* (2013.01)

(58) Field of Classification Search

CPC ..... D05B 19/02; D05B 19/04; D05B 19/08; D05B 19/10; D05B 19/12; D05B 11/00

See application file for complete search history.

(56) References Cited

U.S. PATENT DOCUMENTS

| | | | | |
|---|---|---|---|---|
| 4,834,008 | A * | 5/1989 | Sadeh | D05B 35/102 112/470.04 |
| 4,953,485 | A * | 9/1990 | Brower | D05B 21/00 112/103 |
| 5,027,726 | A * | 7/1991 | Brower | D05B 11/00 112/117 |
| 5,095,835 | A * | 3/1992 | Jernigan | D05B 19/08 112/103 |
| 5,323,722 | A * | 6/1994 | Goto | G05B 19/4205 112/102.5 |
| 5,537,946 | A * | 7/1996 | Sadeh | D05B 19/08 112/470.07 |
| 5,911,182 | A * | 6/1999 | Uyama | D05B 19/08 112/102.5 |
| 6,263,815 | B1 * | 7/2001 | Furudate | D05B 7/00 112/470.13 |
| 6,856,843 | B1 | 2/2005 | Herman, Jr. | |
| 7,373,891 | B2 | 5/2008 | Koerner | |
| 8,074,590 | B2 * | 12/2011 | Bentley | D05B 11/00 112/470.01 |

(Continued)

*Primary Examiner* — Nathan Durham

(74) *Attorney, Agent, or Firm* — Timothy W. Menasco, Esq.; Harter Secrest & Emery LLP

(57) ABSTRACT

The present disclosure provides a method, apparatus, and computer-readable medium for imaging. The method includes capturing, by a device, a plurality of images of a work piece and mapping, by the device, the plurality of images of the work piece to a digital representation of the work piece. The method further includes detecting, by the device, an outline of an existing design within the digital representation of the work piece, wherein the device comprises an image capture device operably connected to a sewing head having a reciprocating needle, the reciprocating needle defining a cycle path, the image capture device being adjacent to a portion of the cycle path.

15 Claims, 3 Drawing Sheets

(56) References Cited

U.S. PATENT DOCUMENTS

| | | | | |
|---|---|---|---|---|
| 8,633,982 | B2 * | 1/2014 | Gylling | D05B 11/00 112/272 |
| 2008/0243298 | A1 * | 10/2008 | Hurd | H04N 1/00132 700/138 |
| 2009/0195649 | A1 * | 8/2009 | Gylling | D05B 11/00 348/125 |
| 2009/0217850 | A1 * | 9/2009 | Tokura | D05B 19/16 112/102.5 |
| 2011/0146553 | A1 * | 6/2011 | Wilhelmsson | D05B 19/10 112/475.19 |
| 2013/0112127 | A1 * | 5/2013 | Tokura | D05B 19/10 112/102.5 |

* cited by examiner

METHOD, APPARATUS AND COMPUTER-READABLE MEDIUM FOR IMAGING

BACKGROUND OF THE INVENTION

Field of the Invention

Exemplary embodiments of the present disclosure relate to a method, apparatus, and computer-readable medium for capturing an image or images. The present disclosure relates more specifically to capturing and manipulating an image or images of a work piece.

Description of Related Art

Machine quilting is quilting made through the use of a sewing machine to stitch in rows or patterns using select techniques to stitch through layers of fabric and batting in the manner of old-style hand-quilting.

Free motion quilting is a process used to stitch the layers of a quilt together using a domestic sewing machine. The operator controls the stitch length as well as the direction of the stitching line by moving the quilt with their hands. The stitching can be made in any direction to produce curvilinear lines or straight patterns. Each design, whether drawn on the quilt top or held in the imagination of the quilter, is formed with a line of stitching that is guided by the movement of the quilt under the machine needle. The length of each stitch is determined by the distance the quilt has been moved since the previous stitch.

Longarm Quilting involves placing the layers to be quilted on a special frame. The frame has bars on which the layers are rolled, keeping these layers together without the need for tacking or pinning. These frames are used with a sewing machine mounted on a moveable platform. The platform rides along tracks so that the sewing machine can move across the layers on the frame. In contrast, a sit down quilting machine provides a stationary sewing machine attached to a flat surface for retaining a work piece. The user moves the work piece underneath the needle of the stationary sewing head of the quilting machine while operating a foot pedal that controls a reciprocating needle that creates a desired quilt or pattern.

Digital imaging is the creation of digital images, typically from a physical scene. The term is often assumed to imply or include the processing, compression, storage, printing, and displaying of such images. A digital photograph may be created directly from a physical scene by a camera or similar device. Alternatively, a digital image may be obtained from another image in an analog medium, such as photographs, photographic film, or printed paper, by an image scanner or similar device.

Edge detection is the name for a set of mathematical methods which aim at identifying points in a digital image at which the image brightness changes sharply or, more formally, has discontinuities. The points at which image brightness changes sharply are typically organized into a set of curved line segments termed edges. The same problem of finding discontinuities in 1D signals is known at step detection and the problem of finding signal discontinuities over time is known as change detection. Edge detection is a fundamental tool in image processing, machine vision and computer vision, particularly in the areas of feature detection and feature extraction.

BRIEF SUMMARY OF THE INVENTION

In view of the foregoing, it is an object of the present disclosure to provide a method, apparatus, and computer-readable medium for imaging.

A first exemplary embodiment of the present disclosure provides a method of imaging. The method includes capturing, by a device, a plurality of images of a work piece and mapping, by the device, the plurality of images of the work piece to a digital representation of the work piece. The method further includes detecting, by the device, an outline of an existing design within the digital representation of the work piece, wherein the device comprises an image capture device operably connected to a sewing head having a reciprocating needle, the reciprocating needle defining a cycle path, the image capture device being adjacent to a portion of the cycle path.

A second exemplary embodiment of the present disclosure provides an apparatus for imaging. The apparatus includes a sewing head including a reciprocating needle, an image capture device relative to the sewing head, a memory including computer program instructions, and a processor, wherein the sewing head including the reciprocating needle, the image capture device, the memory and the processor are configured to cause the apparatus to at least capture a plurality of images of a work piece. The sewing head including the reciprocating needle, the image capture device, the memory and the processor are further configured to cause the apparatus to map the plurality of images of the work piece to a digital representation of the work piece, and detect an outline of an existing design within the digital representation of the work piece.

A third exemplary embodiment of the present disclosure provides a non-transitory computer-readable medium tangibly comprising computer program instructions, which when executed on the processor of an apparatus causes the apparatus to at least capture a plurality of images of a work piece, and map the plurality of images of the work piece to a digital representation of the work piece. The computer program instructions with the processor further cause the apparatus to at least detect an outline of an existing design within the digital representation of the work piece, wherein the apparatus comprises an image capture device operably connected to a sewing head having a reciprocating needle, the reciprocating needle defining a cycle path, the image capture device being adjacent to a portion of the cycle path.

The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

DETAILED DESCRIPTION OF THE INVENTION

In both free motion quilting and in computer-controlled quilting, the user determines the location of each stitch made in the work piece. In some cases in free motion quilting, the user determines the location of each stitch contemporaneously with the actual stitching of the machine. However, in most instances, the user plans the location of each stitch and the overall pattern or design of the quilt or work piece. The difference being that in free motion quilting the user physically moves the reciprocating needle of the sewing head to a specific drop location for stitching, while in computer controlled quilting a computer system controls the movement of the sewing head and the reciprocating needle to create the planned design.

In both instances, it is advantageous for the user to have a visual representation of the projected finished quilt. This will aid the user in the planning process by providing the user with a visualization of what the quilt will likely look like. Additionally, a visual representation of the projected finished quilt will aid the user in navigating around existing patterns or designs that are already located on the work piece.

One way to accomplish this is to take a digital image of the quilt and overlay it with a digital grid. This may help a user specify the drop location of the needle on the work piece by narrowing the location of a digital pattern to a specific block area on the actual work piece. Yet, this solution allows for a substantial amount of error in determining the exact drop location of the reciprocating needle. Additionally, this method fails to take into consideration patterns or designs that already exist on the work piece.

Accordingly, there is a need for a one-to-one correspondence between digital representations of a work piece and the actual work piece to enable accurate stitching. There is also a need for the ability to detect pre-existing patterns and designs on a work piece, and have the ability to automatically adjust the stitching of a pattern in response to detected patterns and designs. For instance, a work piece may not be a blank canvas, but may include a number of different designs or patterns. A user may want to add additional patterns to the work piece without disturbing or stitching over the existing design or patterns.

Figure 1:
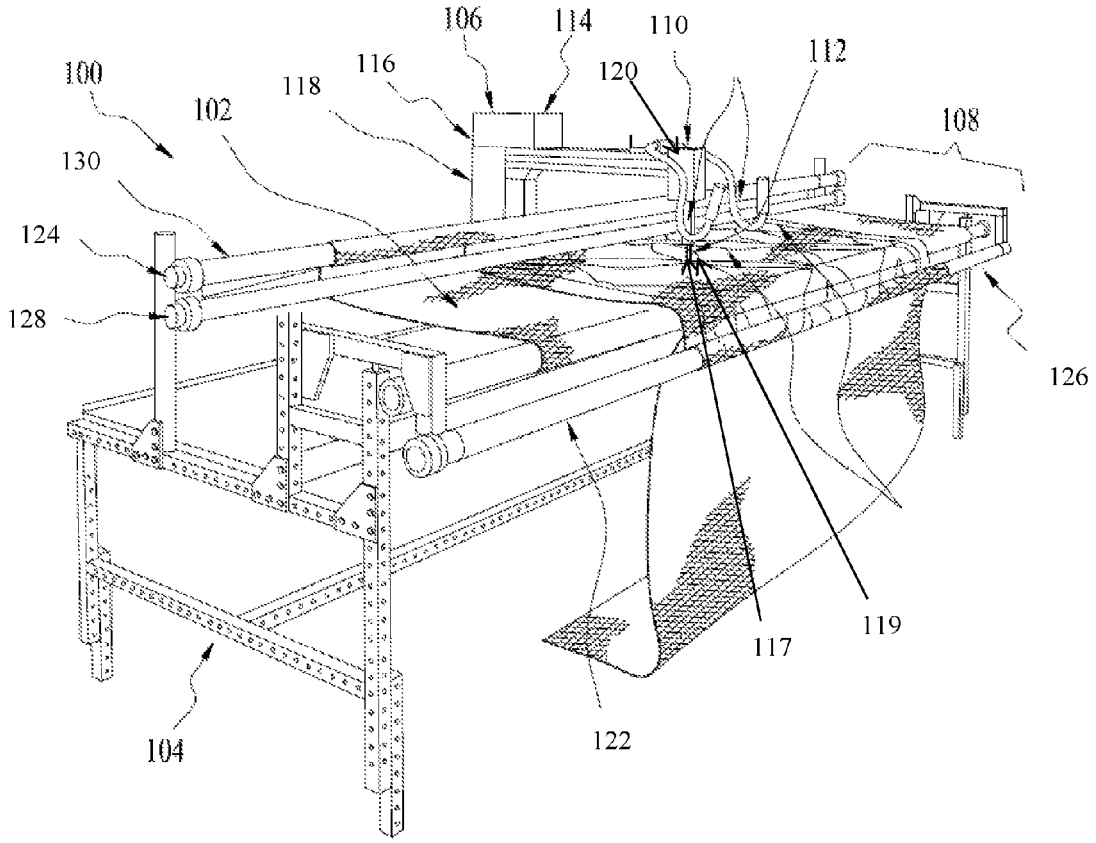
FIG. 1 is a perspective view of a configuration of a device suitable for use in practicing exemplary embodiments of this disclosure.

Referring to FIG. 1, shown is an exemplary quilting machine 100. It should be noted that embodiments of the present disclosure are not limited to the particular configuration of quilting machine 100, but may include many different types of configurations provided they operate as described below.

The term quilting machine 100 encompasses any device for stitching or embroidery of a textile 102. The term quilting machine 100 includes embroidery machines and quilting machines for stitching together multiple layers, such as a filler layer between a top and a bottom textile layer.

Quilting machine 100 includes a main frame 104, a sewing machine 106, support frame 108 for supporting or retaining a textile, a sewing head 110, a reciprocating needle 112, a motor 114, a controller 116, an encoder 118, and an image capture device 120. The controller 116 is operably connected to the sewing head 110 and the encoder 118. The controller 116 can include a computer processor 124 (not shown) and memory 126 (not shown) for storing computer program instructions. The computer program instructions when executed on the computer processor 124 allow quilting machine 100 to perform the operations described below.

The controller 116 can also include a display and input, such as a touch screen, keyboard, keypad, and/or mouse. The controller 122 can be physically connected to the main frame 104 or the sewing machine 106. Alternatively, the controller 116 can be a stand-alone device, which communicates with the sewing machine 106 and the encoder 118 through a wired or wireless connection.

The term textile 102 includes any article of manufacture or fabric made by weaving, felting, knitting, crocheting, compressing natural or synthetic fibers. In one exemplary embodiment, textile 102 is a quilt. It is common to refer to sections of a quilt as a quilt block. A quilt block is a small segment of a quilt top. The combination of a number of quilt blocks together makes a quilt. The blocks can be the same, or different from each other. Quilt blocks can be pieced or appliqued or may represent a given portion of the quilt.

The support frame 104 can be any variety of configurations, wherein the frame includes struts or supports for engaging components described herein. The frame can be made of any of a variety of materials such as metals, plastics, composites, wood or any combination thereof.

Although the present description is set forth in terms of a sewing machine 106 or image capture device 120 that is moved relative to the textile 102 (or work piece), it is understood that the textile 102 can be moved relative to a fixed sewing machine 106 or image capture device 120. Alternatively, both the sewing machine 106 and the textile 102 can be simultaneously moved.

Sewing machine 106 includes the sewing head 110. Typically, sewing head 110 includes a portion above the plane of the work piece retention area and a second portion below the plane of the work piece retention area, thereby providing for passage of a portion of the reciprocating needle 112 through textile 102 and selectively engaging the passage of a length of thread through textile 102. Exemplary embodiments of sewing head 110 are configured to operably move and stitch through the plane of the work piece retention area through the use of a plurality of wheels, gears, rails, slides, or combinations thereof.

Support frame 104 provides a textile retention area that retains textile 102 or a portion of textile 102 relative to main frame 108 and relative to the sewing machine 106. Support frame 104 includes a supply roll assembly 122 and a take up roll assembly 124.

Supply roll assembly 122 retains an initial length of textile wound about a supply roller 126. For quilts with a plurality of layers, such as a quilt with a liner, a filling and a top layer, there may be three supply rollers in the supply roll assembly 122. One of the supply rollers 126 is set such that a portion of the periphery defines a line in a plane of operation of sewing machine 106.

The take up roller assembly 124 includes a bed roller 128 having a portion of the periphery generally coplanar with a portion of the periphery of the supply roller 126 and a take up roller 130 for winding the stitched textile 102.

Support frame 104 retains a portion of the textile 102 (work piece) between the line of contact with one of the supply rollers 126 and the bed roller 128, if the take up roller 130 compensates for changing diameter of the winding. The supply roll assembly 122 and the take up roll assembly 124 create a tension within the textile 102 between the two assemblies, thereby disposing the intermediate textile in a substantially planar orientation and defining the work piece retention area.

Exemplary embodiments of encoder 118 include optical and mechanical sensors for sensing movement of the sewing machine 106 relative to the frame. Encoder 118 operably tracks and communicates a direction and velocity of the sewing head 110 with other elements of quilting machine 100. The encoder 118 is operably connected to the controller 116 to communicate with controller 116 the data necessary to determine the direction, location, and speed of the sewing head 110 relative to the work piece. In one exemplary embodiment, encoder 118 includes at least a first encoder 118 that operably tracks and communicates a direction and velocity of movement of the sewing head 110 in the x-axis direction and a second encoder 118 that operably tracks and communicates a direction and velocity of movement of the sewing head 110 in the y-axis direction. It should be appreciated that embodiments of encoder 118 may be located on or in a body of sewing head 110, and/or the rails, gears, wheels, or the combination thereof on which sewing head 110 moves throughout the work piece retention area.

Exemplary embodiments of quilting machine 100 may further include a first sensor 117 and a second sensor 119. As depicted in FIG. 1, first sensor 117 and second sensor 119 are located adjacent reciprocating needle 112 on sewing head 110. However, exemplary embodiments of quilting machine 100 also include embodiments wherein the first sensor 117 and the second sensor 119 are located beneath textile 102. First sensor 117 and second sensor 119 are operably coupled to controller 116 such that first sensor 117 and second sensor 119 are able to communicate movement data of textile 102 or sewing head 110 to controller 116.

The first sensor 117 and the second sensor 119 are optimally located on opposite sides of the drop location of reciprocating needle 110. Exemplary embodiments of the first sensor 117 and the second sensor 119 include optical sensors, motion sensors or any type of sensor capable of monitoring the movement of the work piece relative to the sewing head 110.

Image capture device 120 as depicted in FIG. 1 is located adjacent to sewing head 110. However, exemplary embodiments of image capture device 120 can be located adjacent reciprocating needle 112 or it can be a stand-alone attachment to quilting machine 100. In both embodiments wherein image capture device 120 is located adjacent sewing head 110 or adjacent reciprocating needle 112, image capture device 120 is operable connected to controller 116 and is able to move with sewing head 110 or reciprocating needle 112. In the stand-alone attachment configuration, image capture device 120 is also operable connected to controller 116 and is moveably coupled to support frame 108 such that image capture device 120 is able to freely move over the work piece retention area through either motorized means or user employed physical means. Exemplary embodiments of image capture device 120 can also be located on or adjacent to any portion of quilting machine 100 that allows image capture device 120 to be operably coupled to controller 116 and to move over the entire work piece retention area such that image capture device 120 can capture an image or a plurality of images which when combined include the entire work piece retention area.

Exemplary embodiments of image capture device 120 include any type of device that can take multiple pictures, scans, panoramic photographs, or video of textile 102. Exemplary image capture devices 120 include digital cameras, digital video cameras, scanners, copiers, and the like. Exemplary embodiments of image capture device 120 are able to communicate with controller 116 and data processor 124 either through a wired or wireless connection.

In one exemplary embodiment image capture device 120 can be moved over textile 102 such that it can take multiple panoramic photographs of the portion of textile 102 that is within the work piece retention area, which when combined, construct a picture of the entire textile 102. In exemplary embodiments, supply roller assembly 122 and take up roller assembly 124 can operate in conjunction with image capture device 120. For example, once image capture device 120 has completed photographing the portion of textile 102 currently in the work piece retention area, supply roller assembly 122 and take up roller assembly 124 incrementally rotate and place different sections of textile 102 in the work piece retention area. Image capture device 120 will photograph each section of textile 120 until all of textile 102 has be photographed. In one exemplary embodiment, supply roller assembly 122 and take up roller assembly 124 can be physically operated by the user providing a new section of textile 102 to the work piece retention area such that image capture device 120 can photograph textile 102. In another exemplary embodiment, supply roller assembly 122 and take up roller assembly 124 are motor controlled or automatically controlled by controller 116.

Once image capture device 120 has photographed or taken a video of the entire work piece, the video or photographs can be transmitted to controller 116 and computer processor 124. Exemplary embodiments of computer processor 124 with memory 126 including computer program instructions are able to combine the photographs or video of textile 102 and map each point in the photographs or video into a digital representation of textile 102. In exemplary embodiments, the digital representation has a one-to-one correspondence to the actual textile 102 such that every point on textile 102 corresponds to a different point on the digital representation of textile 102. Exemplary embodiments of a digital representation of textile 102 include a digital image of textile 102 that can be viewed on a digital screen.

Exemplary embodiments of computer processor 124 and memory 126 including computer program instructions are able to analyze the digital representation of textile 102 and detect the edges of textile 102 and the edges of any design or pattern on textile 102. For instance, textile 102 may include a stitched design of a flower in its center. Accordingly, the digital representation of textile 102 will include a digital representation of the stitched design of a flower. Computer processor 124 and memory 126 including computer program instructions will be able to automatically detect the edges of the stitched design of a flower in textile 102.

Once the edges of a design or pattern has been detected, the user through a user interface or separate electronic device coupled to controller 116 may manipulate the digital representation of textile 102. For instance, the user may add, adjust, manipulate, and design new patterns or designs to be added to textile 102. Since the digital representation of textile 102 provides a one-to-one correspondence to textile 102, any additions, manipulations, or adjustments of the digital representation of textile 102 very closely represent the actual finalized work piece. Accordingly, the user will "know" exactly where on the actual work piece a new design will be added. Exemplary embodiments of a separate electronic device include a personal computer, laptop, tablet, smartphone or the like.

Figure 2:
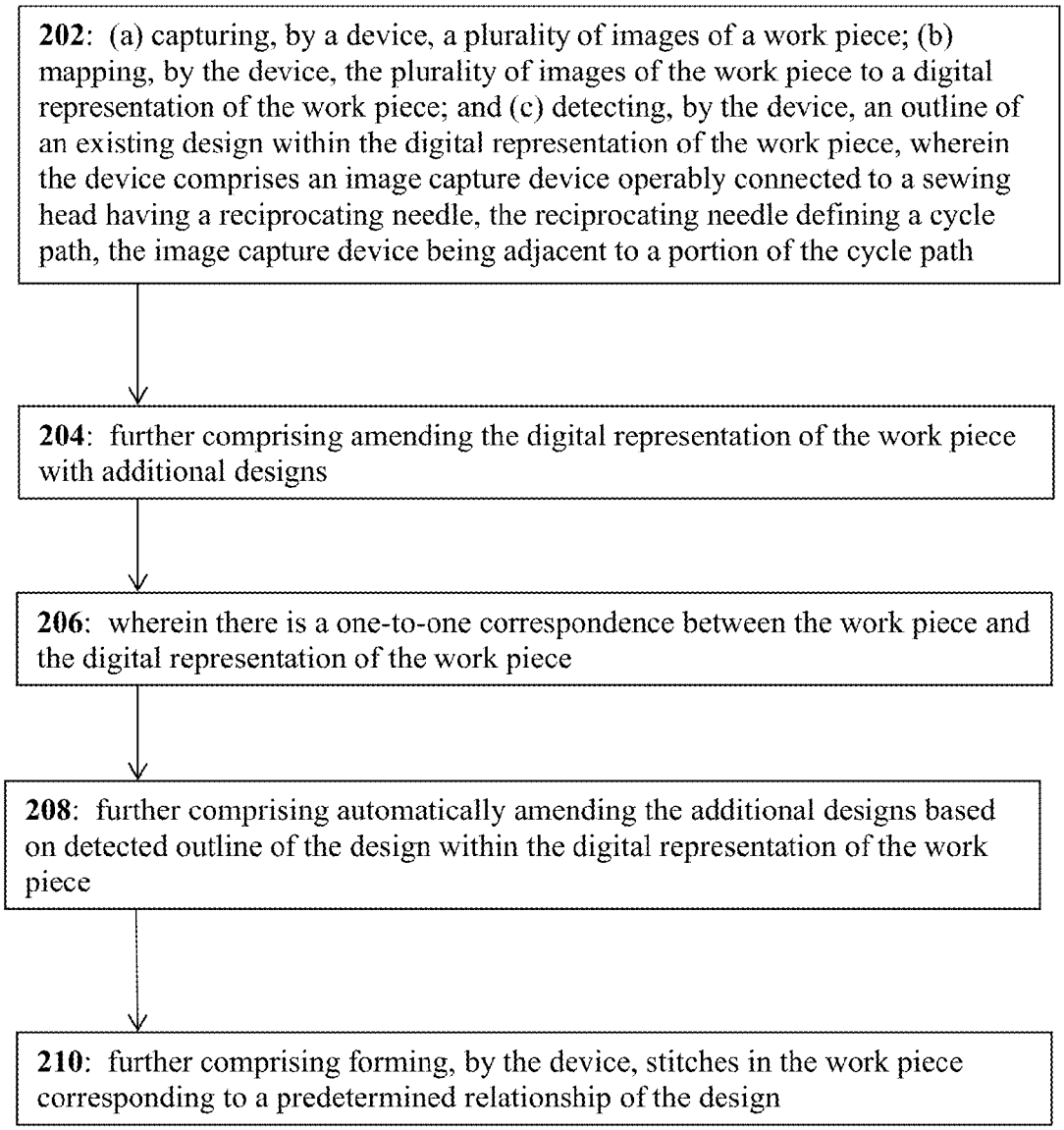
FIG. 2 is a logic flow diagram in accordance with a method, apparatus, and computer-readable medium for performing exemplary embodiments of this disclosure.

Since the edges of any designs or patterns on textile 102 have been detected, exemplary embodiments of computer processor 124 and memory 126 with computer program instructions can automatically adjust additional design stitches such that they do not overlap or interfere with pre-existing stitches or designs in textile 102. For example, textile 102 may include a flower design and the user may wish to add an additional design such as another flower design. But, one of the flower pedals of the new design overlaps with the existing flower design. Exemplary embodiments of computer processor 124 are able to automatically adjust the programmed stitching of the new flower design such that the new flower design stitching does not overlap or interfere with that of the existing flower design. In short, computer processor 124 and memory 126 with computer program instructions automatically manipulate FIG. 2 presents a summary of the above teachings for imaging a work piece. Block 202 presents (a) capturing, by a device, a plurality of images of a work piece; (b) mapping, by the device, the plurality of images of the work piece to a digital representation of the work piece; and (c) detecting, by the device, an outline of an existing design within the digital representation of the work piece, wherein the device comprises an image capture device operably connected to a sewing head having a reciprocating needle, the reciprocating needle defining a cycle path, the image capture device being adjacent to a portion of the cycle path. Then block 204 specifies further comprising amending the digital representation of the work piece with additional designs.

Some of the non-limiting implementations detailed above are also summarized at FIG. 2 following block 204. Block 206 relates to wherein there is a one-to-one correspondence between the work piece and the digital representation of the work piece. Block 208 further specifies further comprising automatically amending the additional designs based on detected outline of the design within the digital representation of the work piece. Block 210 then specifies further comprising forming, by the device, stitches in the work piece corresponding to a predetermined relationship of the design.

Thus, exemplary embodiments of the present disclosure provide an apparatus that can automatically create a one-to-one digital representation of a work piece. Exemplary embodiments of the present disclosure further provide an apparatus that can detect the edges of designs or patterns on the work piece based on a digital representation of the work piece. Exemplary embodiments also allow a user to add or amend the work piece with new designs or patterns that automatically adjust the stitching around the detected edges of designs or patterns.

The logic diagram of FIG. 2 may be considered to illustrate the operation of a method, and a result of execution of computer program instructions stored in a computer-readable memory, and a specific manner in which components of an electronic device are configured to cause that electronic device to operate, whether such an electronic device is a quilting machine or some other device, or one or more components thereof. The various blocks shown in FIG. 2 may also be considered as a plurality of coupled logic circuit elements constructed to carry out the associated function(s), or specific result of strings of computer program instructions or code stored in a memory.

Various embodiments of the computer-readable medium or computer-readable memory include any data storage technology type which is suitable to the local technical environment, including but not limited to semiconductor based memory devices, magnetic memory devices and systems, optical memory devices and systems, fixed memory, removable memory, disc memory, flash memory, dynamic random-access memory (DRAM), static random-access memory (SRAM), electronically erasable programmable read-only memory (EEPROM) and the like. Various embodiments of the processor include, but are not limited to general purpose computers, special purpose computers, microprocessors, digital signal processors and multi-core processors.

Figure 3:
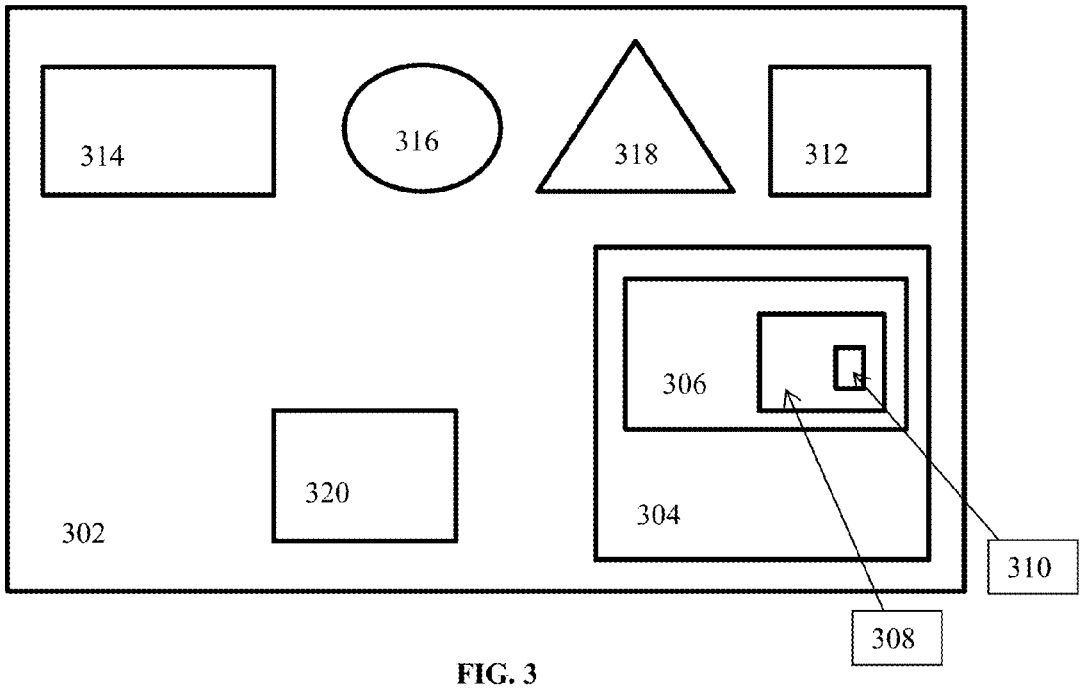
FIG. 3 is a simplified block diagram of a device suitable for use in practicing exemplary embodiments of this disclosure.

Reference is now made to FIG. 3, which illustrates a simplified block diagram of the various elements of a device suitable for use in practicing the exemplary embodiments of this disclosure. As shown in FIG. 3, device 302 is configured for stitching a work piece. Device 302 can be a quilting or sewing machine or any device suitable for stitching together two or more pieces of fabric.

Device 302 includes processing means such as a controller 304, which includes at least one data processor 306, storing means such as a computer-readable memory 308 storing a computer program 310 including computer program instructions. Controller 304, data processor 306, and computer-readable memory 308 with computer program 310 provide a mechanism to interpret, manipulate, and determine a layout of a work piece, including detecting edges of patterns or designs on the work piece. Embodiments of controller 304 include a motion controller for operably controlling movement of device 302.

The device 302 also includes image capture device 312 for capturing an image of a work piece. Image capture device 312 is operable coupled to controller 304, data processor 306 and computer-readable memory 308 such that image capture device 312 is able to transmit image data to controller 304, data processor 306, and computer-readable memory 308. Device 302 further includes motor 314 operably connected to controller 304 and reciprocating needle 316. Reciprocating needle 316 is operably connected to controller 304. The cycle frequency and drop locations of reciprocating needle 316 are controlled by motor 314, which is in turn determined by controller 304.

Device 302 also includes encoder 318 to encode a sensed movement information of image capture device 312 and reciprocating needle 316 over a work piece. Encoder is operably connected to image capture device 312 and reciprocating needle 316 as well as controller 304, data processor 306, and motor 314. Encoder 318 may include at least a first encoder and a second encoder, wherein the first encoder encodes the sensed movement information of device 302 in a x-axis direction and the second encoder encodes the sensed movement information of device 302 in a y-axis direction. Device 302 includes an operational on/off switch 320 for selectively operating controller 304, motor 314, reciprocating needle 316, and encoder 318. In some exemplary embodiments, on/off switch 320 is a foot pedal that can be pressed to operate device 302. In other exemplary embodiments, on/off switch 320 is a physical switch located on device 302 that can be operated by hand.

The computer program 310 in device 302 in exemplary embodiments is a set of program instructions that, when executed by data processor 306, enable device 302 to operate in accordance with the exemplary embodiments of this disclosure as detailed above. In these regards, the exemplary embodiments of this disclosure may be implemented at least in part by a computer software stored in computer-readable memory 308, which is executable by data processor 306. Devices implementing these aspects of the disclosure need not be the entire device as depicted in FIG. 3 or may be one or more components of same such as the above described tangibly stored software, hardware, and data processor.

What is claimed is:

1. A method comprising:

(a) capturing, by a device, a plurality of images of a work piece, the work piece having at least one edge and at least one stitched design;

(b) automatically combining, by the device, the plurality of images of the work piece to a single digital representation of the work piece; and (c) automatically detecting, by the device, the at least one edge and an outline of the stitched design within the single digital representation of the work piece, wherein the device comprises an image capture device operably connected to a sewing head having a reciprocating needle, the reciprocating needle defining a cycle path, the image capture device being adjacent to a portion of the cycle path.

2. The method according to claim 1, the method further comprising amending the single digital representation of the work piece with additional designs.

3. The method according to claim 2, wherein there is a one-to-one correspondence between the work piece and the single digital representation of the work piece.

4. The method according to claim 3, the method further comprising automatically amending the additional designs based on detected outline of the design within the single digital representation of the work piece.

5. The method according to claim 4, the method further comprising forming, by the device, stitches in the work piece corresponding to a predetermined relationship of the design.

6. An apparatus comprising:

a sewing head including a reciprocating needle;

an image capture device operably connected to the sewing head;

a memory including computer program instructions; and a processor, wherein the sewing head including the reciprocating needle, the image capture device, the memory and the processor are configured to cause the apparatus to at least:

capture a plurality of images of a work piece, the work piece having at least one stitched design;

automatically combine the plurality of images of the work piece to a single digital representation of the work piece; and automatically detect an outline of the stitched design within the single digital representation of the work piece.

7. The apparatus according to claim 6, the sewing head including the reciprocating needle, the image capture device, the memory and the processor are further configured to cause the apparatus to at least amend the single digital representation of the work piece with additional designs.

8. The apparatus according to claim 7, wherein there is a one-to-one correspondence between the work piece and the single digital representation of the work piece.

9. The apparatus according to claim 8, the sewing head including the reciprocating needle, the image capture device, the memory and the processor are further configured to cause the apparatus to at least automatically amend the additional designs based on detected outline of the design within the single digital representation of the work piece.

10. The apparatus according to claim 9, the sewing head including the reciprocating needle, the image capture device, the memory and the processor are further configured to cause the apparatus to at least form stitches in the work piece corresponding to a predetermined relationship of the design.

11. A non-transitory computer-readable medium tangibly comprising computer program instructions, which when executed on a processor of an apparatus causes the apparatus to at least:

capture a plurality of images of a work piece, the work piece having at least one stitched design;

combine the plurality of images of the work piece to a single digital representation of the work piece; and automatically detect an outline of the stitched design within the single digital representation of the work piece, wherein the apparatus comprises an image capture device operably connected to a sewing head having a reciprocating needle, the reciprocating needle defining a cycle path, the image capture device being adjacent to a portion of the cycle path.

12. The non-transitory computer-readable medium according to claim 11, the computer program instructions with the processor further cause the apparatus to at least amend the single digital representation of the work piece with additional designs.

13. The non-transitory computer-readable medium according to claim 12, wherein there is a one-to-one correspondence between the work piece and the single digital representation of the work piece.

14. The non-transitory computer-readable medium according to claim 13, the computer program instructions with the processor further cause the apparatus to at least automatically amend the additional designs based on detected outline of the design within the single digital representation of the work piece.

15. The non-transitory computer-readable medium according to claim 14, the computer program instructions with the processor further cause the apparatus to at least form stitches in the work piece corresponding to a predetermined relationship of the design.

* * * * *